US009933729B2

(12) United States Patent
Miyakoshi

(10) Patent No.: US 9,933,729 B2
(45) Date of Patent: Apr. 3, 2018

(54) IMAGE FORMING APPARATUS INCLUDING HOLDING MEMBER MOVABLE BETWEEN A PLURALITY OF POSITIONS TO MAKE INTERMEDIATE TRANSFER BELT COME INTO CONTACT WITH AND SEPARATE FROM PHOTOSENSITIVE BODY

(71) Applicant: KYOCERA Document Solutions Inc., Osaka (JP)

(72) Inventor: Naoto Miyakoshi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/165,296

(22) Filed: May 26, 2016

(65) Prior Publication Data

US 2016/0349672 A1 Dec. 1, 2016

(30) Foreign Application Priority Data

May 29, 2015 (JP) ..... 2015-110592

(51) Int. Cl.
*G03G 15/01* (2006.01)
*G03G 15/16* (2006.01)

(52) U.S. Cl.
CPC ..... *G03G 15/1605* (2013.01); *G03G 15/0136* (2013.01)

(58) Field of Classification Search
CPC ..... G03G 15/0136; G03G 15/1605; G03G 15/1615; G03G 21/168
See application file for complete search history.

(56) References Cited

U.S. PATENT DOCUMENTS 7,400,852 B2 7/2008 Furukawa
9,244,426 B2 * 1/2016 Onodera ..... G03G 21/168
(Continued)

FOREIGN PATENT DOCUMENTS

JP H02-179670 A 7/1990
JP 2002-014545 A 1/2002
(Continued)

OTHER PUBLICATIONS

An Office Action; "Notification of Reasons for Refusal," dated Dec. 12, 2017, which corresponds to Japanese Patent Application No. 2015-110592 and is related to U.S. Appl. No. 15/165,296; with English Translation.

*Primary Examiner* — Walter L Lindsay, Jr.
*Assistant Examiner* — Arlene Heredia Ocasio
(74) *Attorney, Agent, or Firm* — Studebaker & Brackett PC

(57) ABSTRACT

An image forming apparatus includes a photosensitive body, an intermediate transfer belt, a holding member, a primary transfer member, a secondary transfer member, and a biasing member. The intermediate transfer belt comes into contact with and separate from the photosensitive body. The holding member holds the intermediate transfer belt. The biasing member biases the primary transfer member toward a side of the photosensitive body. The holding member is movable between a first holding position to make the intermediate transfer belt come into contact with the photosensitive body and a second holding position to make the intermediate transfer belt separate from the photosensitive body. The primary transfer member moves toward a side remote from the photosensitive body against biasing force of the biasing member in accordance with a movement of the holding member from the first holding position to the second holding position.

7 Claims, 10 Drawing Sheets

(56) References Cited

U.S. PATENT DOCUMENTS

| | | | | |
|---|---|---|---|---|
| 2007/0059054 | A1 | 3/2007 | Furukawa | |
| 2008/0240800 | A1 | 10/2008 | Furukawa | |
| 2009/0190954 | A1* | 7/2009 | Okabe | G03G 15/161 399/111 |
| 2011/0293303 | A1* | 12/2011 | Fujii | G03G 15/161 399/49 |
| 2012/0237260 | A1* | 9/2012 | Sengoku | G03G 15/161 399/162 |
| 2014/0178099 | A1* | 6/2014 | Koshida | G03G 21/1619 399/121 |
| 2015/0078781 | A1* | 3/2015 | Makinodan | G03G 15/1615 399/121 |
| 2015/0309447 | A1* | 10/2015 | Suzuki | G03G 15/1605 399/121 |
| 2015/0338790 | A1* | 11/2015 | Makino | G03G 15/1615 399/299 |

FOREIGN PATENT DOCUMENTS

| | | | |
|---|---|---|---|
| JP | 2007-079570 | A | 3/2007 |
| JP | 2011-028059 | A | 2/2011 |

* cited by examiner

IMAGE FORMING APPARATUS INCLUDING HOLDING MEMBER MOVABLE BETWEEN A PLURALITY OF POSITIONS TO MAKE INTERMEDIATE TRANSFER BELT COME INTO CONTACT WITH AND SEPARATE FROM PHOTOSENSITIVE BODY

INCORPORATION BY REFERENCE

This application is based on and claims the benefit of priority from Japanese patent application No. 2015-110592 filed on May 29, 2015, the entire contents of which are incorporated herein by reference.

BACKGROUND

The present disclosure relates to an image forming apparatus, and in particular to an image forming apparatus which includes an intermediate transfer belt and adopts a secondary transfer manner.

Conventionally, an image forming apparatus which includes an intermediate transfer belt and adopts a secondary transfer manner is known.

For example, there is an image forming apparatus which includes a photosensitive body configured to carry a toner image, an intermediate transfer belt configured to come into contact with and separate from the photosensitive body, a primary transfer member configured to primarily transfer the toner image on the photosensitive body to the intermediate transfer belt, and a secondary transfer member configured to secondarily transfer the toner image on the intermediate transfer belt to a recording medium.

SUMMARY

In accordance with an embodiment of the present disclosure, an image forming apparatus includes a photosensitive body, an intermediate transfer belt, a holding member, a primary transfer member, a secondary transfer member, and a biasing member. The photosensitive body is configured to carry a toner image. The intermediate transfer belt is configured to come into contact with and separate from the photosensitive body. The holding member is configured to hold the intermediate transfer belt. The primary transfer member is configured to primarily transfer the toner image on the photosensitive body to the intermediate transfer belt. The secondary transfer member is configured to secondarily transfer the toner image on the intermediate transfer belt to a recording medium. The biasing member is configured to bias the primary transfer member toward a side of the photosensitive body. The holding member is movable between a first holding position to make the intermediate transfer belt come into contact with the photosensitive body and a second holding position to make the intermediate transfer belt separate from the photosensitive body. The primary transfer member moves toward a side remote from the photosensitive body against biasing force of the biasing member in accordance with a movement of the holding member from the first holding position to the second holding position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Hereinafter, an MFP 1 (image forming apparatus) according to a first embodiment of the present disclosure will be described with reference to the drawings. Arrows Fr, Rr, L, R, U and Lo optionally added to each drawing indicate a front side, a rear side, a left side, a right side, an upper side and a lower side of the MFP 1, respectively.

Firstly, an outline of the configuration of the MFP 1 will be explained.

Figure 1:
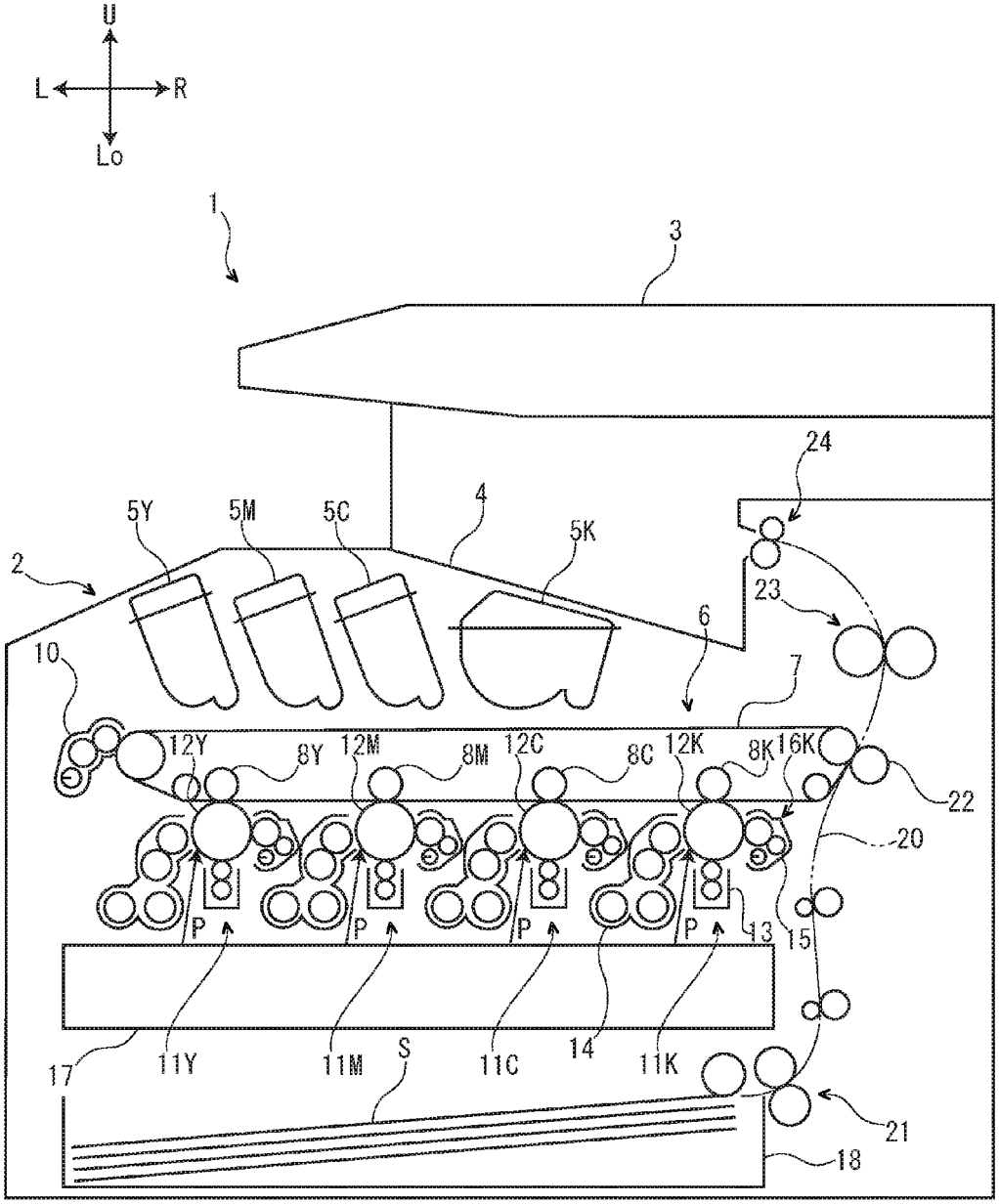
FIG. 1 is a schematic diagram showing an outline of an MFP (multifunction peripheral) according to a first embodiment of the present disclosure.

As shown in FIG. 1, the MFP 1 includes a box-formed MFP main body 2 (apparatus main body). In an upper end part of the MFP main body 2, an image reading device 3 to read an original image is arranged. In an upper part of the MFP main body 2, a sheet ejecting tray 4 is arranged below the image reading device 3. In the upper part of the MFP main body 2, four toner containers 5Y, 5M, 5C, 5K are housed below the sheet ejecting tray 4. Each toner container 5Y, 5M, 5C, 5K contains a toner of yellow, magenta, cyan and black, respectively.

In a roughly middle part of the MFP main body 2, an intermediate transfer unit 6 is arranged below the four toner containers 5Y, 5M, 5C, 5K. The intermediate transfer unit 6 includes an intermediate transfer belt 7 and four primary transfer rollers 8Y, 8M, 8C, 8K (primary transfer members). Each primary transfer roller 8Y, 8M, 8C, 8K corresponds to the toner of yellow, magenta, cyan and black, respectively. Incidentally, details of the configuration of the intermediate transfer unit 6 will be described later. A cleaning unit 10 is arranged at a left side of the intermediate transfer unit 6.

In the roughly middle part of the MFP main body 2, four image forming parts 11Y, 11M, 11C, 11K are arranged below the intermediate transfer unit 6. Each image forming part 11Y, 11M, 11C, 11K corresponds to the toner of yellow, magenta, cyan and black, respectively. Image forming parts 11Y, 11M, 11C, 11K include photosensitive drums 12Y, 12M, 12C, 12K, respectively. The photosensitive drums 12Y, 12M, 12C (color photosensitive bodies) are photosensitive bodies configured to carry color toner images, and the photosensitive drum 12K (a black photosensitive body) is a photosensitive body configured to carry a black toner image. Each photosensitive drum 12Y, 12M, 12C, 12K faces each primary transfer roller 8Y, 8M, 8C, 8K via the intermediate transfer belt 7.

The image forming part 11K is provided with a charger 13, a developing device 14 and a cleaning device 15 which are arranged around the photosensitive drum 12K. The photosensitive drum 12K, the charger 13 and the cleaning device 15 are integrated as a drum unit 16K. The drum unit 16K is detachably attached to the MFP main body 2. Incidentally, explanation of configurations of the image forming parts 11Y, 11M, 11C will be omitted, since they are similar to that of the image forming part 11K.

In a lower part of the MFP main body 2, a laser scanning device 17 is housed below the four image forming parts 11Y, 11M, 11C, 11K. In the lower end part of the MFP main body 2, a sheet feeding tray 18 is housed below the laser scanning device 17. In the sheet feeding tray 18, a sheet S (a recording medium) is accommodated.

At a right side part of the MFP main body 2, a conveying path 20 for the sheet S is arranged. At a lower end part (an upstream end part) of the conveying path 20, a sheet feeding part 21 is arranged. At an intermediate stream part of the conveying path 20, a secondary transfer roller 22 (a secondary transfer member) is arranged. At an upper part (a downstream part) of the conveying path 20, a fixing device 23 is arranged. At an upper end part (a downstream end part) of the conveying path 20, a sheet ejecting unit 24 is arranged.

Next, the operation of the MFP 1 with such a configuration will be explained.

When an instruction to start printing is given to the MFP 1, firstly, a surface of each photosensitive drum 12Y, 12M, 12C, 12K is electrically charged by each charger 13. Then, an electrostatic latent image is formed on the surface of each photosensitive drum 12Y, 12M, 12C, 12K by a laser light (refer to an arrow P in FIG. 1) from the laser scanning device 17. Then, the electrostatic latent image is developed by each developing device 14 by using the toner supplied from each toner container 5Y, 5M, 5C, 5K, so that the toner image is formed. The toner image formed on each photosensitive drum 12Y, 12M, 12C, 12K in this way is primarily transferred to the surface of the intermediate transfer belt 7 in turn by each primary transfer roller 8Y, 8M, 8C, 8K. According to this, a full-color toner image is formed on the intermediate transfer belt 7. Incidentally, the toner remained on each photosensitive drum 12Y, 12M, 12C, 12K is removed by each cleaning device 15.

On the other hand, the sheet S picked from the sheet feeding tray 18 by the sheet feeding part 21 is conveyed to a downstream side of the conveying path 20. To the sheet S, the secondary transfer roller 22 secondarily transfers the full-color toner image on the intermediate transfer belt 7. The toner remained on the intermediate transfer belt 7 is removed by the cleaning unit 10.

The sheet S to which the toner image is secondarily transferred is further conveyed to the downstream side of the conveying path 20 and enters the fixing device 23. In the fixing device 23, the toner image is fixed on the sheet S. Each sheet S on which the toner image is fixed is ejected by the sheet ejecting unit 24 on the sheet ejecting tray 4.

Next, a configuration of the intermediate transfer unit 6 will be described in detail.

Figure 2:
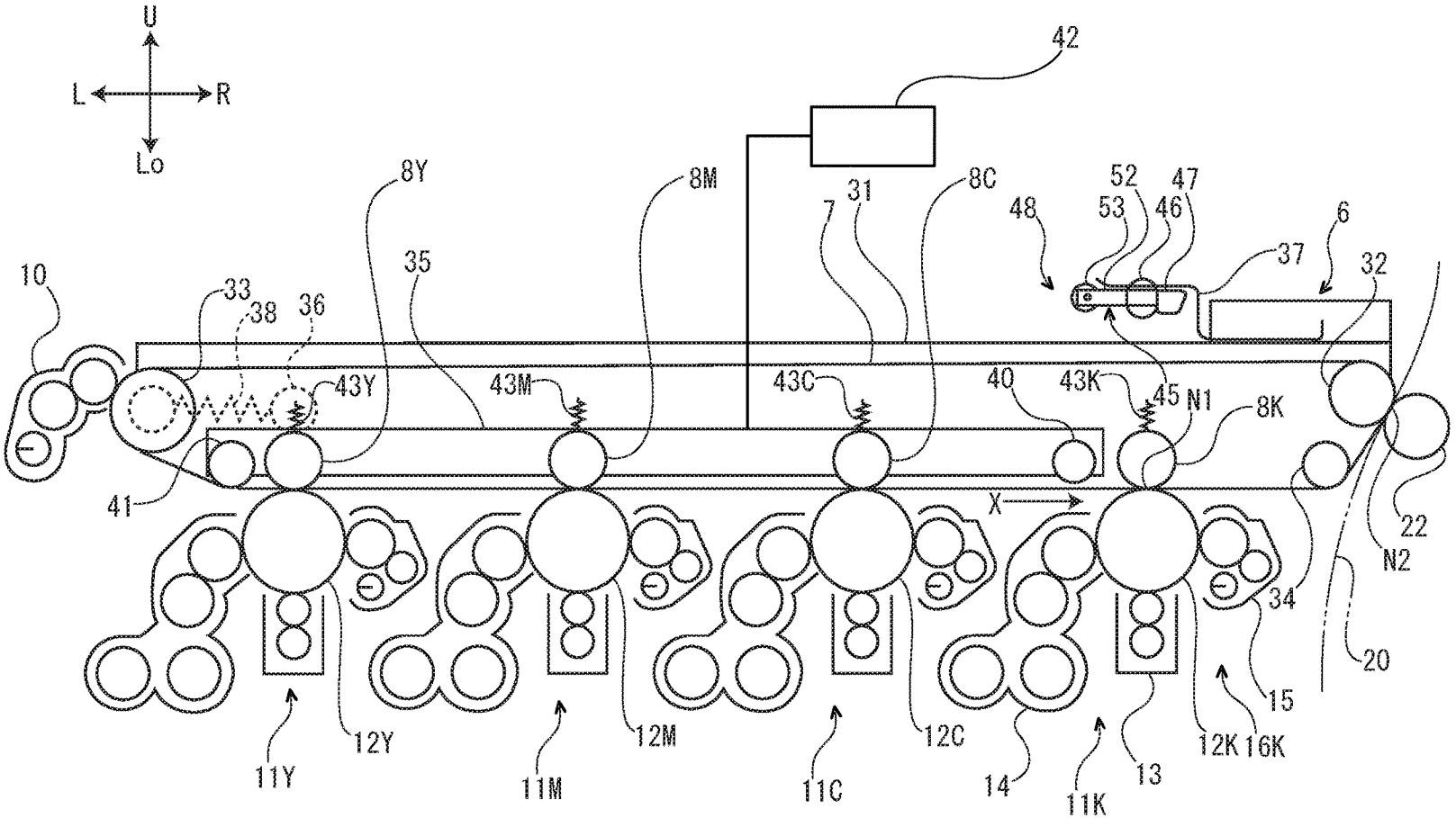
FIG. 2 is a front view showing a state where the MFP according to the first embodiment of the present disclosure is in a color mode.

As shown in FIG. 2, the intermediate transfer unit 6 includes a unit main body 31 (a holding member), a driving roller 32 which is rotatably supported by an upper right part of the unit main body 31, a tension roller 33 which is rotatably supported by an upper left part of the unit main body 31, a supporting roller 34 which is rotatably supported by a lower right part of the unit main body 31, the above-mentioned intermediate transfer belt 7 which is wound around the driving roller 32, the tension roller 33 and the supporting roller 34, a swinging member 35 which is accommodated in the intermediate transfer belt 7, and the above-mentioned primary transfer rollers 8Y, 8M, 8C, 8K which are arranged in a row along a lower part of the intermediate transfer belt 7.

At a left part of the unit main body 31, a supporting axis 36 is arranged, and the unit main body 31 is supported by the MFP main body 2 so that the unit main body 31 is swingable around the supporting axis 36. At the upper right part of the unit main body 31, a pair of front and rear pressed pieces 37 are arranged. Each pressed piece 37 is formed by bending one sheet metal, and is formed in a nearly Z shape.

The driving roller 32 is connected with a driving part (not shown) formed by a motor or the like, and driving force of the driving part rotates the driving roller 32. The tension roller 33 is biased leftward by a tension spring 38, and applies a tension to the intermediate transfer belt 7.

The intermediate transfer belt 7 has flexibility, and is endless in a circumferential direction. The intermediate transfer belt 7 is held by the unit main body 31 via the driving roller 32, the tension roller 33 and the supporting roller 34. The intermediate transfer belt 7 runs in a predetermined running direction (see an arrow X in FIG. 2) with a rotation of the driving roller 32.

At a right end part (a first end part in a longitudinal direction) of the swinging member 35, a swinging axis 40 is arranged, and the swinging member 35 is supported by the unit main body 31 so that the swinging member 35 is swingable around the swinging axis 40. By a left end part (a second end part in the longitudinal direction) of the swinging member 35, a guide roller 41 is rotatably supported. The guide roller 41 guides a lower left part of the intermediate transfer belt 7 from an inside. The swinging member 35 is connected with a swinging source 42 formed by a motor or the like, and the swinging source 42 is configured to swing the swinging member 35.

The primary transfer roller 8K (a black primary transfer member) is rotatably supported by the lower right part of the unit main body 31. The primary transfer roller 8K is arranged at a rightmost side (at the most downstream side in a running direction of the intermediate transfer belt 7) among the four primary transfer rollers 8Y, 8M, 8C, 8K. The primary transfer roller 8K is biased toward a lower side (a side of the photosensitive drum 12K) by a biasing member 43K formed by a coil spring. Thus, the primary transfer roller 8K presses the intermediate transfer belt 7 toward the lower side (the side of the photosensitive drum 12K).

Each primary transfer roller 8Y, 8M, 8C (each color primary transfer member) is rotatably supported by the swinging member 35. Each primary transfer roller 8Y, 8M, 8C is biased toward the lower side (a side of each photosensitive drum 12Y, 12M, 12C) by each biasing member 43Y, 43M, 43C formed by a coil spring. Thus, each primary transfer roller 8Y, 8M, 8C presses the intermediate transfer belt 7 toward the lower side (the side of the photosensitive drums 12Y, 12M, 12C).

Figure 3:
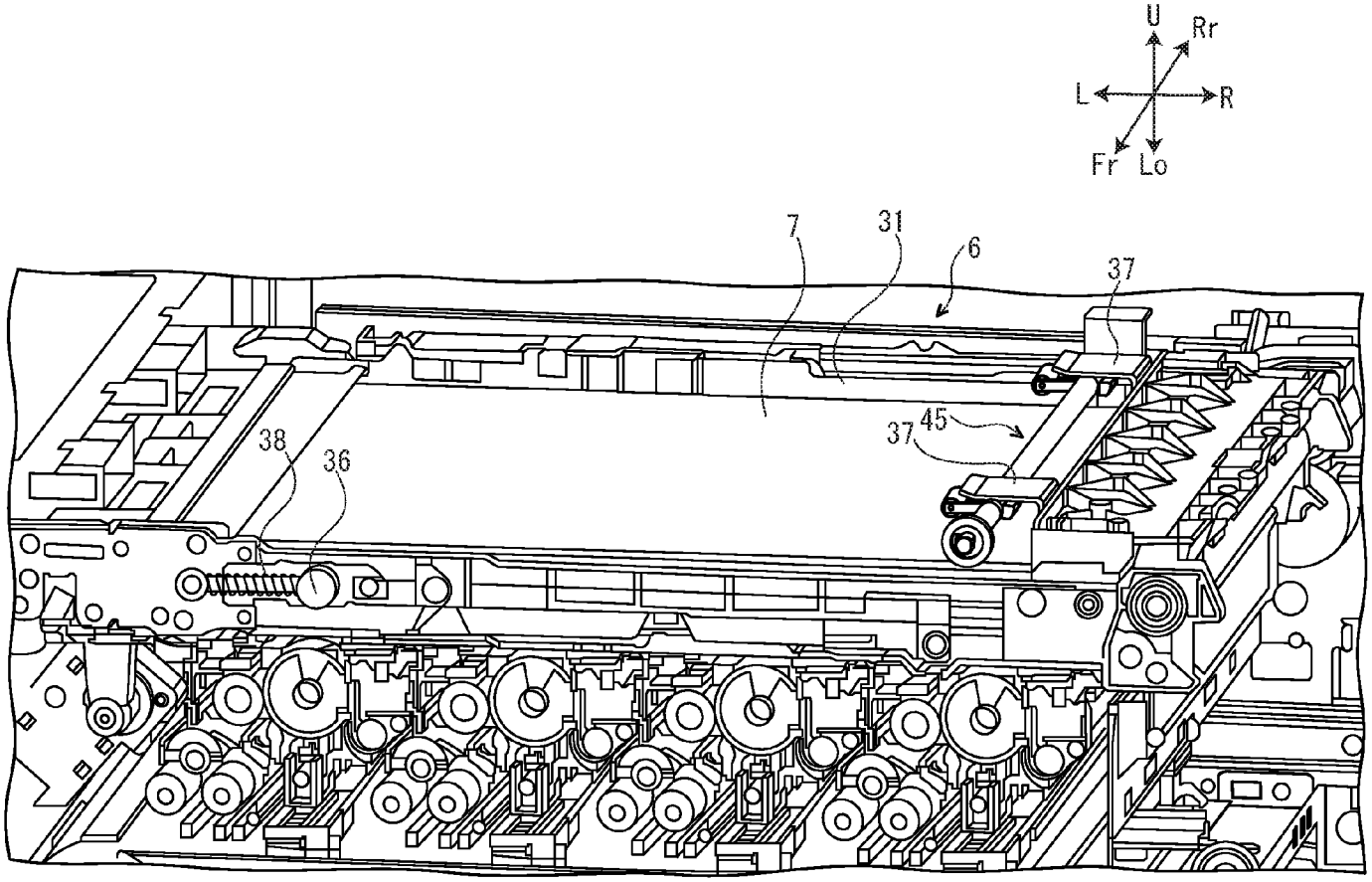
FIG. 3 is a perspective view showing an intermediate transfer unit and its periphery, in the MFP according to the first embodiment of the present disclosure.

As shown in FIG. 3 and other figures, at an upper right side of the intermediate transfer unit 6 configured as described above, a pressing member 45 is arranged.

Figure 4:
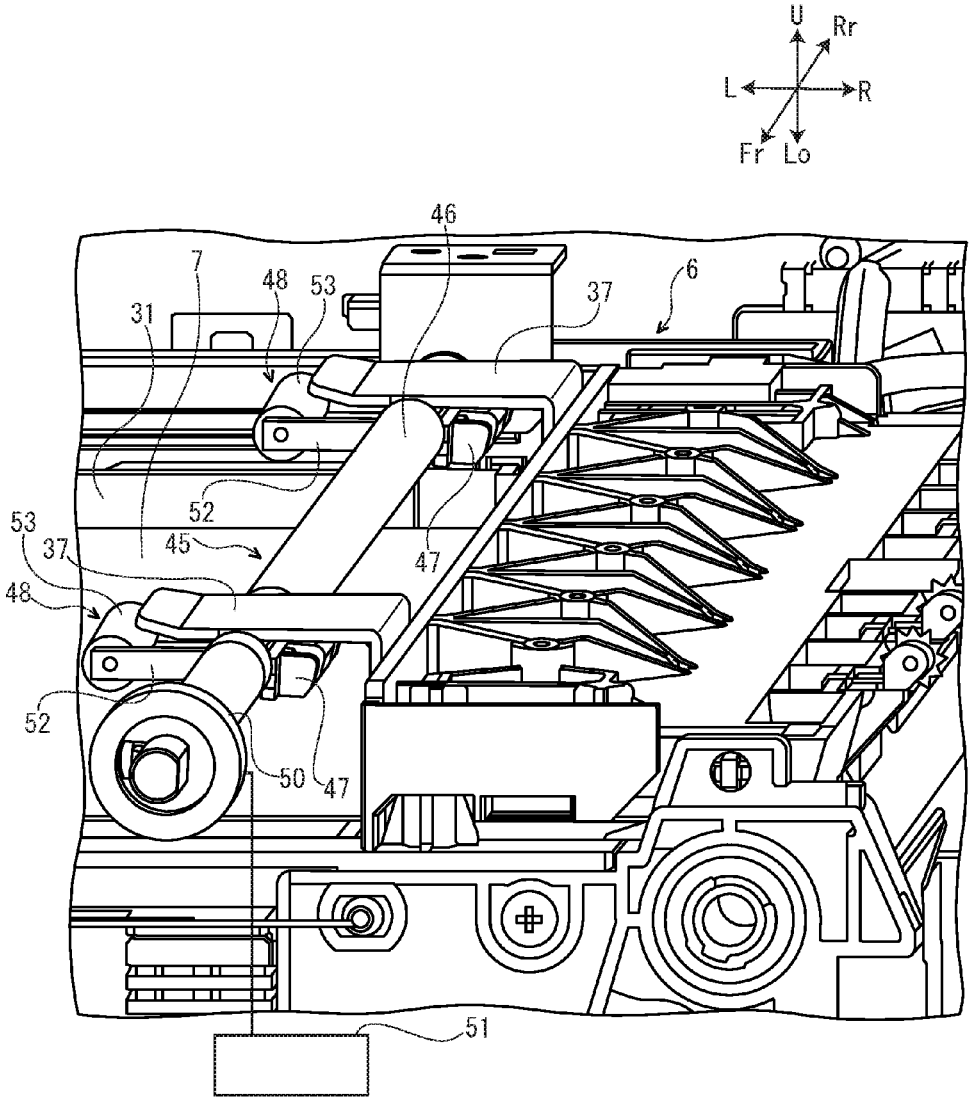
FIG. 4 is a perspective view showing a pressing member and its periphery, in the MFP according to the first embodiment of the present disclosure.
Figure 5:
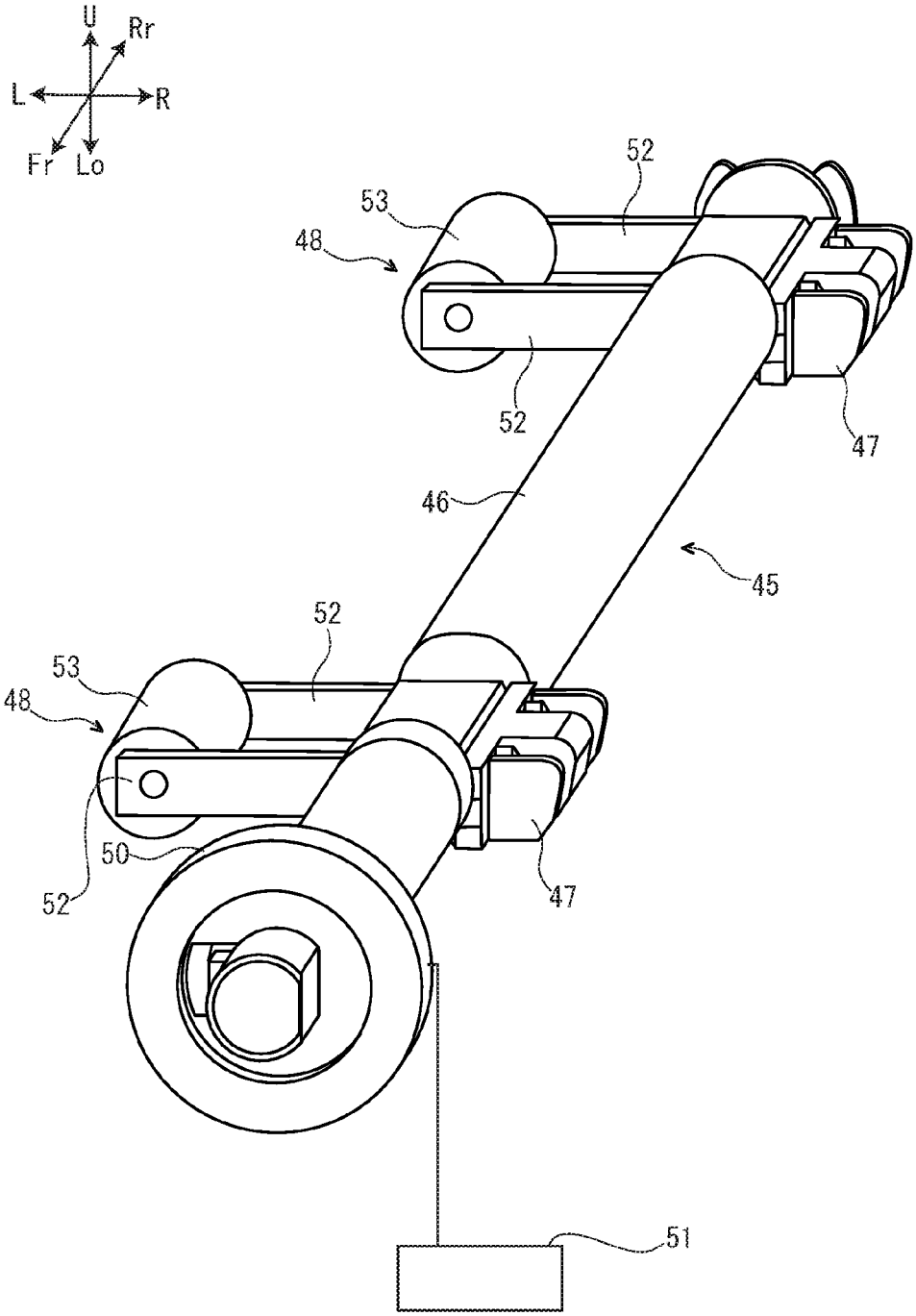
FIG. 5 is a perspective view showing the pressing member, in the MFP according to the first embodiment of the present disclosure.

As shown in FIGS. 4 and 5 and other figures, the pressing member 45 includes a rotation axis 46, a pair of cams 47 which are protruded at outer circumferences of a front part and a rear end part of the rotation axis 46, and a pair of pressing pieces 48 which are protruded at the outer circumferences of the front part and the rear end part of the rotation axis 46, and is supported by the MFP main body 2 so that the pressing member 45 is rotatable around the rotation axis 46.

The rotation axis 46 of the pressing member 45 extends along a front and rear direction. At a front end part of the rotation axis 46, a driving gear 50 is fixed. The driving gear 50 is connected with a driving source 51 formed by a motor or the like, and, when driving force of the driving source 51 is transmitted to the rotation axis 46 via the driving gear 50, the pressing member 45 rotates around the rotation axis 46.

Each cam 47 of the pressing member 45 is arranged below each pressed piece 37 of the unit main body 31. Each pressing piece 48 of the pressing member 45 includes a pair of front and rear supporting arm parts 52 which extend from the outer circumference of the rotation axis 46, and a roller part 53 which is rotatably supported by distal end parts of a pair of the front and rear supporting arm parts 52. A position in the front and rear direction (a position in an axial direction of the rotation axis 46) of each cam 47 corresponds to that of each pressing piece 48. Each cam 47 and each pressing piece 48 extend in opposite directions from the rotation axis 46.

To primarily transfer the full-color toner image on the intermediate transfer belt 7 in the MFP 1 configured as described above, as shown in FIG. 2, the intermediate transfer belt 7 comes into contact with the four photosensitive drums 12Y, 12M, 12C, 12K. Hereinafter, this state will be referred to as a "color mode", a position of the unit main body 31 in this state will be referred to as a "first holding position", and a position of the swinging member 35 in this state will be referred to as a "first swinging position".

Figure 6:
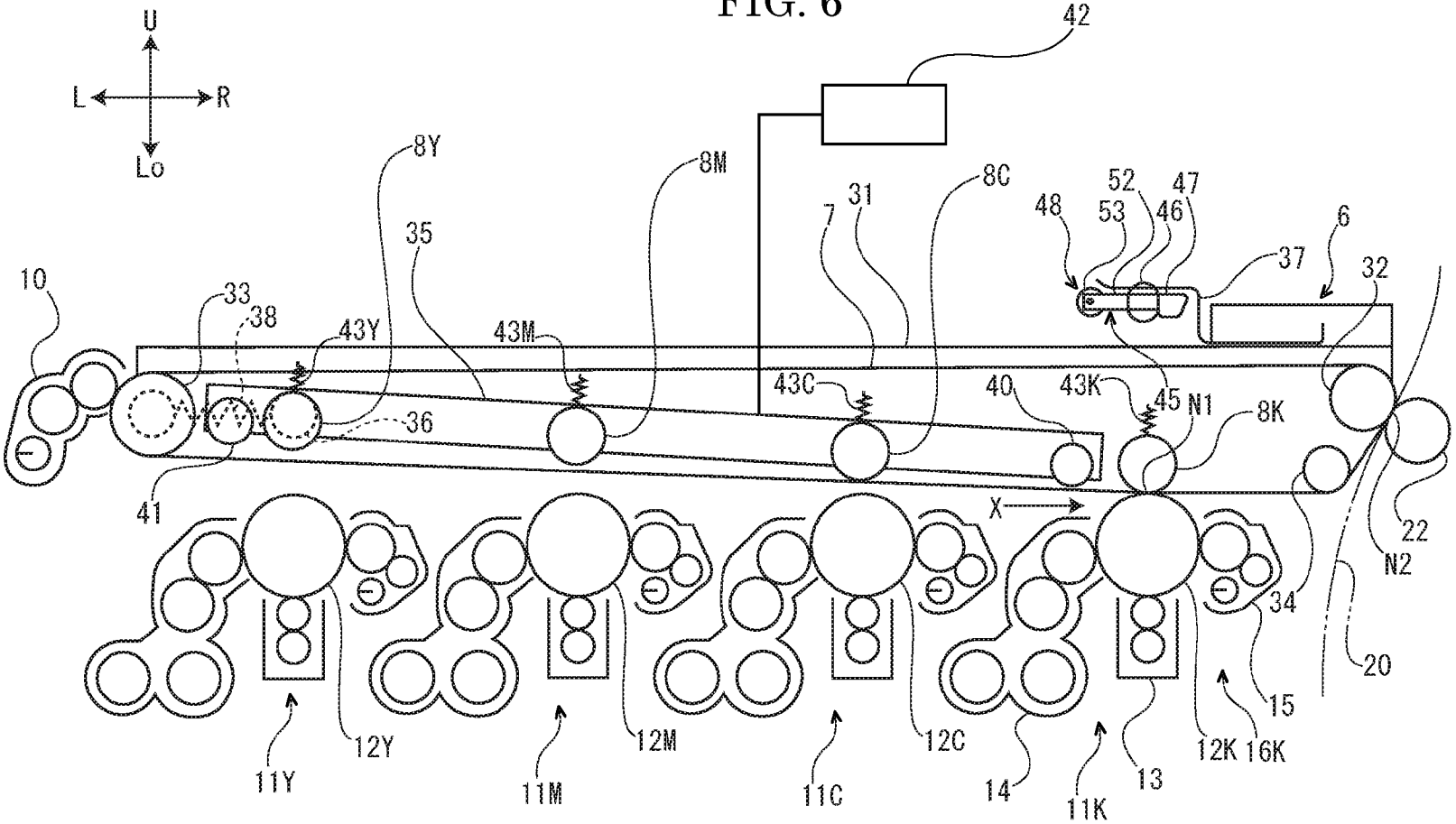
FIG. 6 is a front view showing a state where the MFP according to the first embodiment of the present disclosure is in a monochrome mode.

Meanwhile, to primarily transfer a black toner image on the intermediate transfer belt 7, as shown in FIG. 6, the swinging source 42 swings the swinging member 35 toward an upper side compared to the first swinging position. A position of the swinging member 35 in this state will be referred to as a "second swinging position".

When the swinging member 35 swings from the first swinging position to the second swinging position as described above, each primary transfer roller 8Y, 8M, 8C and the guide roller 41 supported by the swinging member 35 are lifted. According to this, the lower left part of the intermediate transfer belt 7 rises, and the intermediate transfer belt 7 is separated from the photosensitive drums 12Y, 12M, 12C. Incidentally, the primary transfer roller 8K is not supported by the swinging member 35, and therefore is not lifted even when the swinging member 35 swings from the first swinging position to the second swinging position. Hence, contact of the intermediate transfer belt 7 and the photosensitive drum 12K is maintained. Hereinafter, this state will be referred to as a "monochrome mode".

Figure 7:
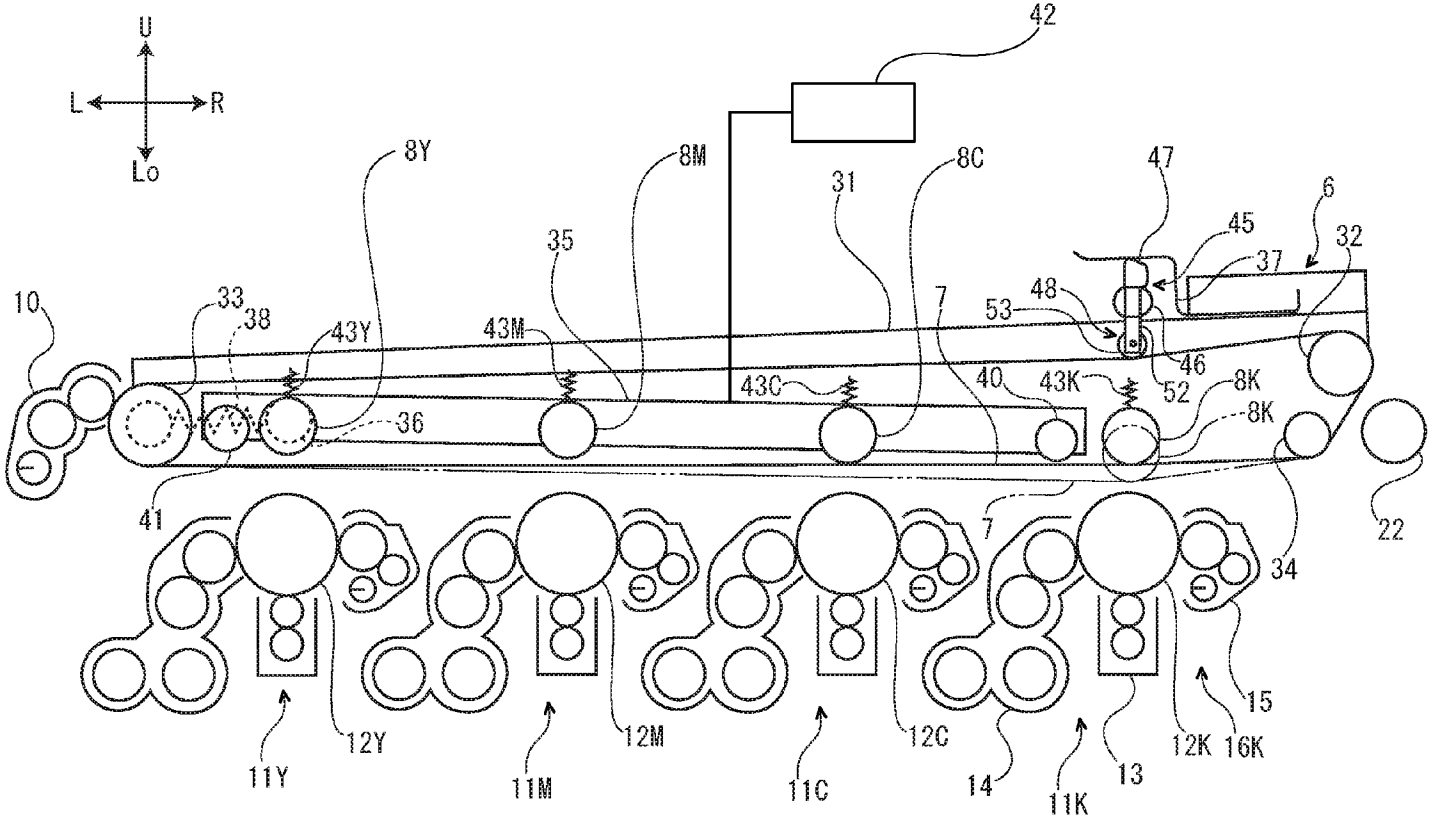
FIG. 7 is a front view showing a state where the MFP according to the first embodiment of the present disclosure is in an all separating mode.

Meanwhile, when a toner image is not primarily transferred on the intermediate transfer belt 7 (when the drum unit 16K is exchanged, for example), as shown in FIG. 7, the driving source 51 (not shown in FIG. 7) rotates the pressing member 45. When the pressing member 45 rotates as described above, each cam 47 of the pressing member 45 presses each pressed piece 37 of the unit main body 31 toward the upper side. According to this, the unit main body 31 swings toward the upper side around the supporting axis 36. A position of the unit main body 31 in this state will be referred to as a "second holding position".

When the unit main body 31 swings from the first holding position to the second holding position as described above, the primary transfer roller 8K supported by the unit main body 31 is lifted. According to this, a lower right part of the intermediate transfer belt 7 rises, so that the intermediate transfer belt 7 is separated from the photosensitive drum 12K.

That is, the intermediate transfer belt 7 is separated from all of the four photosensitive drums 12Y, 12M, 12C, 12K. Hereinafter, this state will be referred to as an "all separating mode". As described above, the intermediate transfer belt 7 is arranged to come into contact with and separate from each of the photosensitive drums 12Y, 12M, 12C, 12K. In other words, the intermediate transfer belt 7 is switchable between a posture to come into contact with each of the photosensitive drums 12Y, 12M, 12C, 12K and another posture to separate from each of the photosensitive drums 12Y, 12M, 12C, 12K.

By the way, in the present embodiment, as described above, biasing force of the biasing member 43K biases the primary transfer roller 8K toward the lower side (the side of the photosensitive drum 12K). Therefore, there is a concern that, when a mode transition from the monochrome mode to the all separating mode is carried out, the biasing force of the biasing member 43K presses down the primary transfer roller 8K (see a two-dot chain line in FIG. 7). There is a concern that, when the primary transfer roller 8K is pressed down in this way, the lower right part of the intermediate transfer belt 7 is pressed down by the primary transfer roller 8K, and is deflected (see a two-dot chain line in FIG. 7). According to this, there is a concern that a clearance between the intermediate transfer belt 7 and the photosensitive drum 12K becomes insufficient, and, during an exchange of the drum unit 16K, the photosensitive drum 12K comes into contact with the intermediate transfer belt 7.

However, in the present embodiment, during the mode transition from the monochrome mode to the all separating mode as described above, when the pressing member 45 rotates around the rotation axis 46, each roller part 53 of each pressing piece 48 of the pressing member 45 presses the upper right part (a part opposite to the photosensitive drum 12K) of the intermediate transfer belt 7 toward the lower side. According to this, a tension is applied to the intermediate transfer belt 7, a deflection of the intermediate transfer belt 7 is restricted, and the lower right part of the intermediate transfer belt 7 pushes the primary transfer roller 8K toward an upper side (a side remote from the photosensitive drum 12K) and lifts the primary transfer roller 8K. Hence, the primary transfer roller 8K moves toward the upper side (the side remote from the photosensitive drum 12K) against the biasing force of the biasing member 43K (see the solid line in FIG. 7). According to this, a lower part of the intermediate transfer belt 7 also moves toward the upper side (the side remote from the photosensitive drum 12K).

In the present embodiment, as described above, in accordance with a swing of the unit main body 31 from the first holding position to the second holding position, the primary transfer roller 8K moves toward the upper side (the side remote from the photosensitive drum 12K) against the biasing force of the biasing member 43K. By applying such a configuration, it is possible to sufficiently secure a clearance between the intermediate transfer belt 7 and the photosensitive drum 12K, and it is possible to prevent the photosensitive drum 12K from coming into contact with the intermediate transfer belt 7 during an exchange of the drum unit 16K.

Further, the intermediate transfer belt 7 is configured to move the primary transfer roller 8K toward the upper side (the side remote from the photosensitive drum 12K) to secure a clearance between the intermediate transfer belt 7 and the photosensitive drum 12K, and therefore it is not necessary to increase a movement amount of the intermediate transfer belt 7 to secure the clearance between the intermediate transfer belt 7 and the photosensitive drum 12K. Hence, it is possible to minimize the movement amount of the intermediate transfer belt 7 and it is possible to reduce the height of the MFP 1.

Further, when the pressing member 45 rotates around the rotation axis 46, each pressing piece 48 presses the intermediate transfer belt 7, and the intermediate transfer belt 7 moves the primary transfer roller 8K toward the upper side (the side remote from the photosensitive drum 12K). By applying such a configuration, it is possible to move the primary transfer roller 8K toward the upper side (the side remote from the photosensitive drum 12K) by a simple configuration.

Further, when the pressing member 45 rotates around the rotation axis 46, each cam 47 of the pressing member 45 presses each pressed piece 37 of the unit main body 31 and the unit main body 31 swings from the first holding position to the second holding position. By applying such a configuration, it is possible to reliably swing the unit main body 31 from the first holding position to the second holding position.

Further, when the pressing member 45 rotates around the rotation axis 46, each roller part 53 of each pressing piece 48 of the pressing member 45 presses the intermediate transfer belt 7. By applying such a configuration, it is possible to prevent the intermediate transfer belt 7 from being damaged or worn away by contact with each pressing piece 48.

Further, the unit main body 31 is swingable between the first holding position to make the intermediate transfer belt 7 come into contact with the photosensitive drum 12K (black photosensitive body) and the second holding position to make the intermediate transfer belt 7 separate from the photosensitive drum 12K, and the swinging member 35 is swingable between the first swinging position to make the intermediate transfer belt 7 come into contact with the photosensitive drums 12Y, 12M, 12C (color photosensitive bodies), and the second swinging position to make the intermediate transfer belt 7 separate from the photosensitive drums 12Y, 12M, 12C. By applying such a configuration, it is possible to switch the modes of MFP 1 between the color mode, the monochrome mode and the all separating mode.

In the present embodiment, the pressing member 45 is rotated by the driving source 51 formed by the motor or the like. In other embodiments, the pressing member 45 may be rotated manually.

In the present embodiment, the configuration of the present disclosure is applied to the MFP 1. In other embodiments, the configuration of the present disclosure may be applied to an image forming apparatus other than the MFP 1, such as a printer, a copying machine, a scanner, or a facsimile.

Second Embodiment

Next, an MFP 61 (image forming apparatus) according to a second embodiment of the present disclosure will be described with reference to the drawings. Arrows Fr, Rr, L, R, U and Lo optionally added to each figure indicate a front side, a rear side, a left side, a right side, an upper side and a lower side of the MFP 61, respectively. Incidentally, members having the same configurations as the first embodiment will be shown by the same reference numerals as the first embodiment and their explanation will be omitted.

Figure 8:
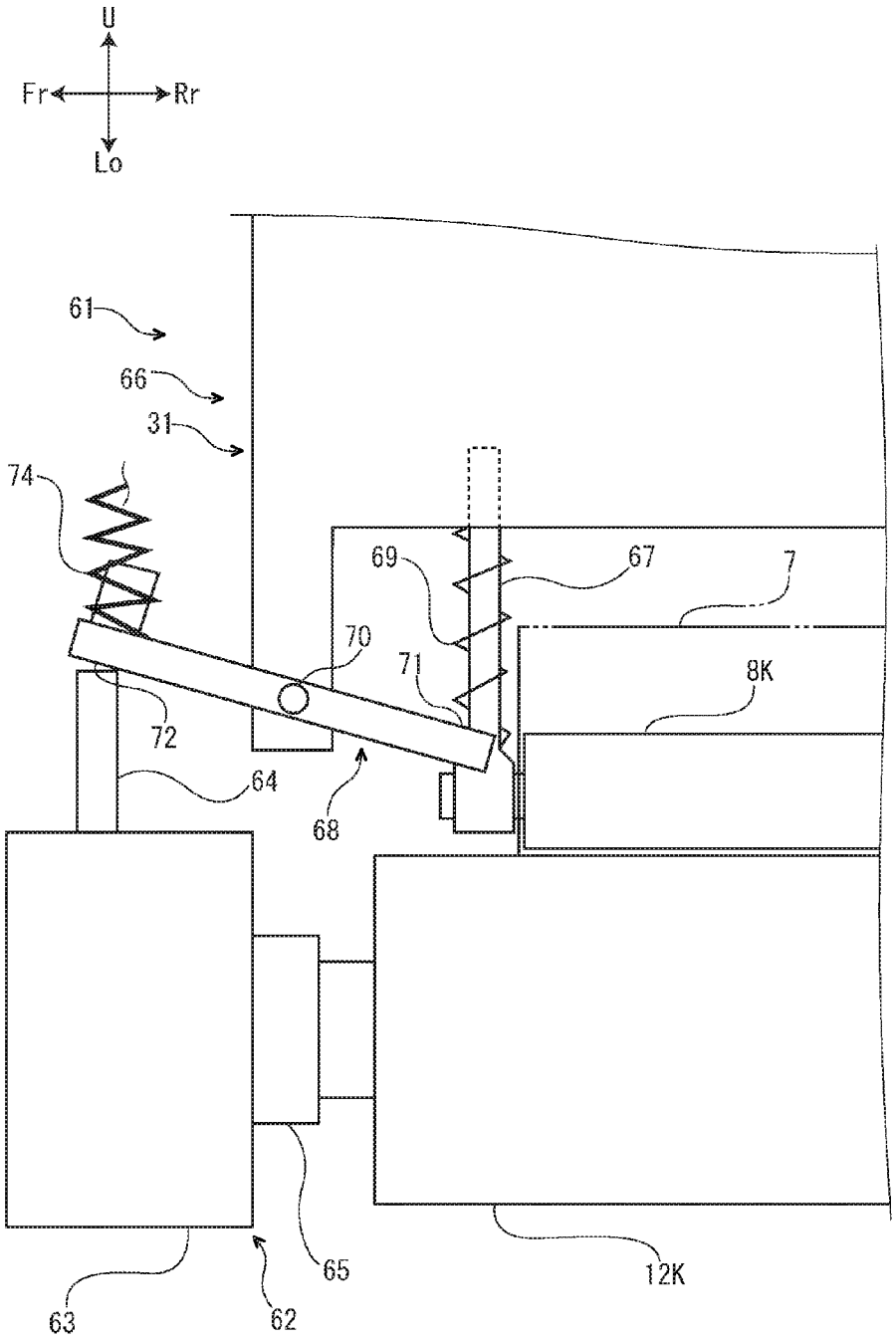
FIG. 8 is a side view showing a state where an MFP according to a second embodiment of the present disclosure is in a monochrome mode.

As shown in FIG. 8, the MFP 61 includes a pair of front and rear contact members 62 (FIG. 8 shows the front contact member 62 alone). The contact members 62 are arranged at a front side and a rear side of the photosensitive drum 12K, respectively. Each contact member 62 includes a main body part 63, and a protruded part 64 which is protruded upward from a top face of the main body part 63. The main body part 63 rotatably supports each of both front and rear end parts of the photosensitive drum 12K via a bearing 65.

The MFP 61 includes an intermediate transfer unit 66. The intermediate transfer unit 66 includes each member provided to the intermediate transfer unit 6 according to the first embodiment, and, in addition, a pair of front and rear bushes 67 (FIG. 8 shows the front bush 67 alone) and arm members 68 (FIG. 8 shows the front arm member 68 alone) arranged at an outside in the front and rear direction of the bushes 67 (at a front side of the front bush 67 and at a rear side of the rear bush 67).

Each bush 67 is supported movably in an upper and lower direction by the unit main body 31 of the intermediate transfer unit 66. Each bush 67 rotatably holds both front and rear end parts of the primary transfer roller 8K (FIG. 8 shows the front end part of the primary transfer roller 8K alone). At an outer circumference of each bush 67, a biasing member 69 formed by a coil spring is attached. Each biasing member 69 biases the primary transfer roller 8K toward the lower side (the side of the photosensitive drum 12K) via each bush 67.

Each arm member 68 includes a fulcrum part 70, a first arm part 71 which extends from the fulcrum part 70 toward one direction, and a second arm part 72 which extends from the fulcrum part 70 toward another direction different from the one direction (a direction opposite to the one direction in the present embodiment). Each arm member 68 is supported by the unit main body 31 of the intermediate transfer unit 66 so that each arm member 68 is swingable around the fulcrum part 70. The first arm part 71 is coupled with each bush 67, and is connected with the primary transfer roller 8K via each bush 67. The second arm part 72 comes into contact with each protruded part 64 of each contact member 62. The second arm part 72 is biased toward the lower side (the side of the protruded part 64) by a biasing body 74 formed by a coil spring. Biasing force of the biasing body 74 is larger than that of the biasing member 69.

Figure 9:
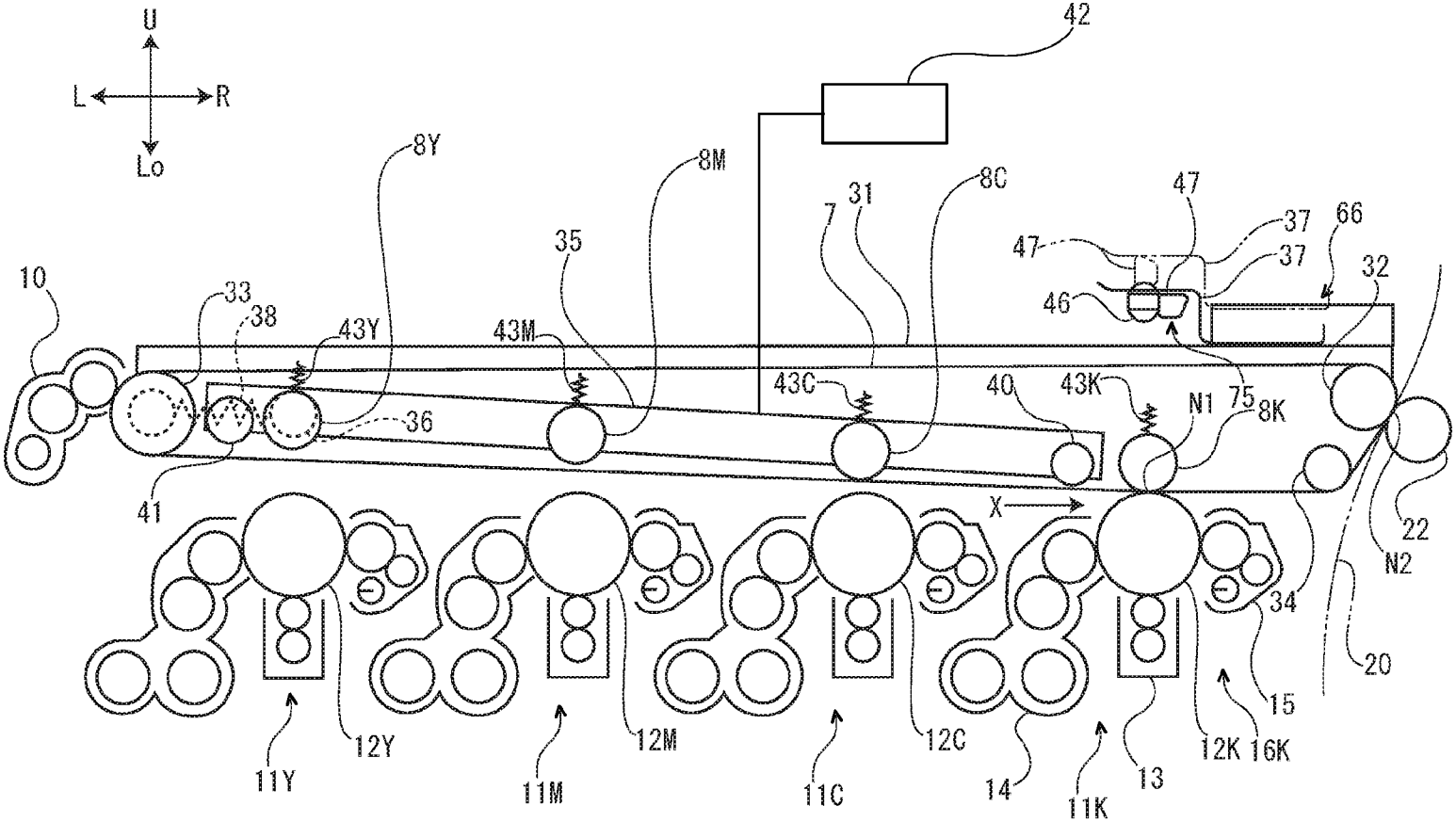
FIG. 9 is a front view showing the state where the MFP according to the second embodiment of the present disclosure is in the monochrome mode.

As shown in FIG. 9, at an upper right side of the intermediate transfer unit 66 configured as described above, a pressing member 75 is arranged. A configuration of the pressing member 75 is the same as that of the pressing member 45 according to the first embodiment except that the pressing member 75 does not include the pressing pieces 48, and therefore explanation of the configuration of the pressing member 75 will be omitted.

To primarily transfer a black toner image on the intermediate transfer belt 7 in the MFP 61 as described above, as shown in FIG. 9, the intermediate transfer belt comes into contact with the photosensitive drum 12K alone. Hereinafter, this state will be referred to as a "monochrome mode", and a position of the unit main body 31 in this state will be referred to as a "first holding position".

Meanwhile, when a toner image is not primarily transferred on the intermediate transfer belt 7 (when the drum unit 16K is exchanged, for example), the driving source 51 (not shown in FIG. 9) rotates the pressing member 75. When the pressing member 75 rotates in this way, as indicated by a two-dot chain line in FIG. 9, each cam 47 of the pressing member 75 presses each pressed piece 37 of the unit main body 31 toward the upper side. According to this, the unit main body 31 swings toward the upper side around the supporting axis 36. A position of the unit main body 31 in this state will be referred to as a "second holding position".

When the unit main body 31 swings from the first holding position to the second holding position in this way, the primary transfer roller 8K supported by the unit main body 31 is lifted. According to this, the lower right part of the intermediate transfer belt 7 rises, and the intermediate transfer belt 7 is separated from the photosensitive drum 12K.

That is, the intermediate transfer belt 7 is separated from all of the four photosensitive drums 12Y, 12M, 12C, 12K. Hereinafter, this state will be referred to as an "all separate mode".

Figure 10:
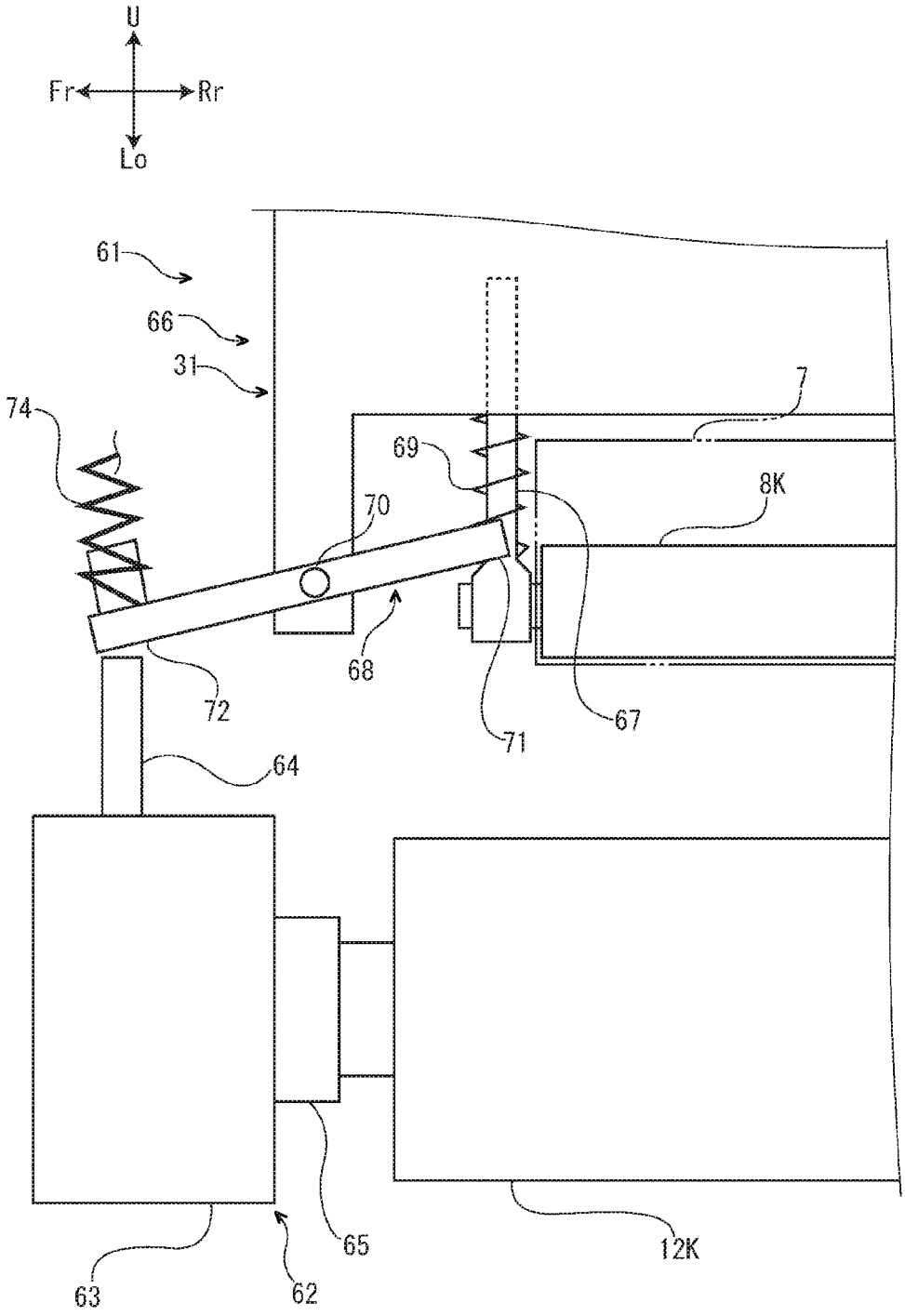
FIG. 10 is a side view showing a state where the MFP according to the second embodiment of the present disclosure is in an all separating mode.

Further, when the unit main body 31 swings from the first holding position to the second holding position as described above, as shown in FIG. 10, each arm member 68 supported by the unit main body 31 rises. When each arm member 68 rises in this way, contact of the second arm part 72 of each arm member 68 and the protruded part 64 of each contact member 62 is released. Hence, the arm member 68 swings around the fulcrum part 70, and the first arm part 71 and the primary transfer roller 8K move toward the upper side (the side remote from the photosensitive drum 12K). According to this, a lower part of the intermediate transfer belt 7 also moves toward the upper side (the side remote from the photosensitive drum 12K).

In the present embodiment, contact of the second arm part 72 of each arm member 68 and each contact member 62 is configured to be released, so that the arm member 68 swings around the fulcrum part 70 and the first arm part 71 of each arm member 68 and the primary transfer roller 8K move toward the upper side (the side remote from the photosensitive drum 12K). By applying such a configuration, it is possible to move the primary transfer roller 8K toward the upper side (the side remote from the photosensitive drum 12K) by a simple configuration.

Further, the biasing force of the biasing body 74 is larger than the biasing force of the biasing member 69. By applying such a configuration, it is possible to reliably swing the arm members 68.

Further, the first arm part 71 of each arm member 68 is coupled with each bush 67. By applying such a configuration, it is possible to connect the first arm part 71 with the primary transfer roller 8K without preventing a rotation of the primary transfer roller 8K.

Further, each contact member 62 includes the main body part 63 which rotatably supports the photosensitive drum 12K, and the protruded part 64 which is protruded from the main body part 63 and is contactable with the second arm part 72. By applying such a configuration, it is possible to simplify the configuration of the MFP 1 compared to a case where a member which rotatably supports the photosensitive drum 12K and a member which comes into contact with the second arm part 72 are separately provided.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. An image forming apparatus comprising:

a photosensitive body configured to carry a toner image;

an intermediate transfer belt configured to come into contact with and separate from the photosensitive body;

a holding member configured to hold the intermediate transfer belt;

a primary transfer member configured to primarily transfer the toner image on the photosensitive body to the intermediate transfer belt;

a secondary transfer member configured to secondarily transfer the toner image on the intermediate transfer belt to a recording medium;

a biasing member configured to bias the primary transfer member toward a side of the photosensitive body; and a pressing member arranged above the intermediate transfer belt, wherein the holding member is movable between a first holding position to make the intermediate transfer belt come into contact with the photosensitive body and a second holding position to make the intermediate transfer belt separate from the photosensitive body, and the primary transfer member moves toward a side remote from the photosensitive body against biasing force of the biasing member in accordance with a movement of the holding member from the first holding position to the second holding position, wherein the photosensitive body comes into contact with the intermediate transfer belt from a lower side, and the primary transfer member comes into contact with the intermediate transfer belt from an upper side so as to press the intermediate transfer belt toward a lower side, when the pressing member rotates, the pressing member presses the intermediate transfer belt toward a lower side, and a tension is applied to the intermediate transfer belt, and the intermediate transfer belt lifts the primary transfer member so as to move the primary transfer member toward an upper side, wherein the holding member includes a pressed piece formed by bending one sheet metal and arranged above the intermediate transfer belt, and when the pressing member rotates, the pressing member presses the pressed piece toward the upper side while pressing the intermediate transfer belt toward the lower side so as to swing the holding member toward the upper side.

2. The image forming apparatus according to claim 1, wherein the pressing member includes:

a rotation axis; and a pressing piece protruded at an outer circumference of the rotation axis, wherein the pressing piece presses the intermediate transfer belt and the intermediate transfer belt moves the primary transfer member toward the side remote from the photosensitive body, when the pressing member rotates around the rotation axis.

3. The image forming apparatus according to claim 2, wherein the pressing member further includes a cam protruded at the outer circumference of the rotation axis, and the cam presses the holding member and the holding member moves from the first holding position to the second holding position, when the pressing member rotates around the rotation axis.

4. The image forming apparatus according to claim 2, wherein the pressing piece includes:

a supporting arm part configured to extend from the outer circumference of the rotation axis; and a roller part rotatably supported by the supporting arm part, and the roller part presses the intermediate transfer belt, when the pressing member rotates around the rotation axis.

5. The image forming apparatus according to claim 1, further comprising a swinging member swingably supported by the holding member, wherein there are a plurality of photosensitive bodies which include:

a black photosensitive body configure to carry a black toner image; and a color photosensitive body configured to carry a color toner image, and the holding member is movable between the first holding position to make the intermediate transfer belt come into contact with the black photosensitive body and the second holding position to make the intermediate transfer belt separate from the black photosensitive body, and the swinging member is swingable between a first swinging position to make the intermediate transfer belt come into contact with the color photosensitive body and a second swinging position to make the intermediate transfer belt separate from the color photosensitive body.

6. The image forming apparatus according to claim 5, wherein a swinging axis is arranged at a first end part in a longitudinal direction of the swinging member, and the swinging member is supported by the holding member so that the swinging member is swingable around the swinging axis.

7. The image forming apparatus according to claim 6, wherein a guide roller configured to guide the intermediate transfer belt from an inside is arranged at a second end part in the longitudinal direction of the swinging member.

* * * * *